US007086662B2

(12) United States Patent
Dodge

(10) Patent No.: US 7,086,662 B2
(45) Date of Patent: Aug. 8, 2006

(54) SKI BINDING

(75) Inventor: David Dodge, Willinston, VT (US)

(73) Assignee: Trak Sports USA, Inc., Burlington, VT (US)

( * ) Notice: Subject to any disclaimer, the term of this patent is extended or adjusted under 35 U.S.C. 154(b) by 0 days.

(21) Appl. No.: 09/774,351

(22) Filed: Jan. 30, 2001

(65) Prior Publication Data

US 2002/0101063 A1 Aug. 1, 2002

(51) Int. Cl.
*A63C 9/08* (2006.01)

(52) U.S. Cl. ..... 280/618; 280/629; 280/633

(58) Field of Classification Search ..... 280/11.31, 280/613, 616, 617, 618, 623, 624, 626, 633, 280/14.22, 14.23, 14.24, 607, 629, 630
See application file for complete search history.

(56) References Cited

U.S. PATENT DOCUMENTS

| | | | | | |
|---|---|---|---|---|---|
| 3,145,027 | A | * | 8/1964 | Berchtold et al. | 280/636 |
| 3,667,770 | A | * | 6/1972 | Lawrence | 280/629 |
| 3,731,943 | A | * | 5/1973 | Wilkes | 280/613 |
| 3,764,155 | A | * | 10/1973 | Perryman | 280/618 |
| 3,866,929 | A | | 2/1975 | Lacroix | 280/11.35 |
| 3,936,064 | A | * | 2/1976 | D'Alessio et al. | 280/620 |
| 3,937,480 | A | * | 2/1976 | Korger | 280/618 |
| 3,944,237 | A | | 3/1976 | Teague, Jr. | 280/11.35 |
| 3,964,760 | A | | 6/1976 | Riedel | 280/605 |
| 3,966,218 | A | * | 6/1976 | Beyl | 280/618 |
| 4,052,086 | A | | 10/1977 | Eckart | 280/618 |
| 4,063,752 | A | | 12/1977 | Whitaker et al. | 280/624 |
| 4,073,509 | A | | 2/1978 | Gertsch | 280/618 |
| 4,134,603 | A | * | 1/1979 | Zoor | 280/614 |
| 4,182,525 | A | | 1/1980 | Spademan | 280/624 |
| 4,185,851 | A | | 1/1980 | Salomon | 280/613 |
| 4,190,264 | A | * | 2/1980 | Himmetsberger et al. | 280/618 |
| 4,219,217 | A | * | 8/1980 | Gertsch | 280/629 |
| 4,270,770 | A | | 6/1981 | Spademan | 280/624 |
| 4,312,517 | A | | 1/1982 | Spademan | 280/605 |
| 4,314,714 | A | | 2/1982 | Gertsch | 280/630 |
| 4,336,955 | A | * | 6/1982 | Schmidt | 280/618 |
| 4,340,243 | A | | 7/1982 | Spademan | 280/624 |
| 4,352,508 | A | | 10/1982 | Spademan | 280/624 |
| 4,360,218 | A | | 11/1982 | Spademan | 280/624 |
| 4,360,219 | A | | 11/1982 | Spademan | 280/624 |
| 4,395,055 | A | | 7/1983 | Spademan | 280/624 |
| 4,407,520 | A | | 10/1983 | Spademan | 280/624 |
| 4,429,896 | A | | 2/1984 | Spademan | 280/624 |
| 4,465,295 | A | | 8/1984 | Spademan | 280/612 |
| 4,492,387 | A | | 1/1985 | Spademan | 280/624 |
| 4,505,494 | A | * | 3/1985 | Gertsch | 280/618 |
| 4,533,156 | A | * | 8/1985 | Gertsch | 280/629 |
| 4,561,672 | A | * | 12/1985 | Spitaler | 280/618 |
| 4,589,673 | A | * | 5/1986 | Dimier et al. | 280/630 |
| 4,600,214 | A | | 7/1986 | Spademan | 280/624 |
| 4,660,849 | A | | 4/1987 | Sedlmair et al. | 280/625 |
| 4,676,522 | A | | 6/1987 | Hue | 280/615 |
| 4,679,815 | A | | 7/1987 | Pascal et al. | 280/618 |
| 4,709,942 | A | * | 12/1987 | Dimier et al. | 280/618 |

(Continued)

*Primary Examiner*—Paul N. Dickson
*Assistant Examiner*—Laura B. Rosenberg
(74) *Attorney, Agent, or Firm*—Bourque & Associates, P.A.

(57) ABSTRACT

The present invention relates to a safety ski binding for a ski or a ski board, which has central attaching means, and is capable of reacting to the friction between the boot and the binding. This is achieved by providing a pair of plates which are moveable one in relation to the other. A portion of the front and rear boot holding cups being moveably attached to each plate.

14 Claims, 15 Drawing Sheets

U.S. PATENT DOCUMENTS

| | | | | | |
|---|---|---|---|---|---|
| 4,768,792 | A | | 9/1988 | Spademan | 280/632 |
| 4,779,891 | A | * | 10/1988 | Freisinger et al. | 280/625 |
| 4,792,157 | A | * | 12/1988 | Stritzl et al. | 280/618 |
| 4,797,185 | A | | 1/1989 | Polak et al. | 204/129 |
| 4,867,471 | A | * | 9/1989 | Stritzl et al. | 280/618 |
| 4,892,326 | A | | 1/1990 | Svoboda et al. | 280/618 |
| 4,893,831 | A | * | 1/1990 | Pascal et al. | 280/618 |
| 4,930,802 | A | * | 6/1990 | Sedlmair | 280/625 |
| 5,040,819 | A | * | 8/1991 | Horn | 280/618 |
| 5,044,654 | A | | 9/1991 | Meyer | 280/613 |
| 5,044,656 | A | * | 9/1991 | Peyre | 280/618 |
| 5,044,657 | A | | 9/1991 | Freisinger et al. | 280/625 |
| 5,129,668 | A | | 7/1992 | Hecht | 280/607 |
| 5,145,202 | A | | 9/1992 | Miller | 280/613 |
| 5,149,123 | A | * | 9/1992 | Rohrmoser | 280/618 |
| 5,213,356 | A | * | 5/1993 | Rohrmoser | 280/607 |
| 5,240,275 | A | * | 8/1993 | Jungkind | 280/618 |
| 5,282,643 | A | * | 2/1994 | Jungkind | 280/626 |
| 5,636,455 | A | * | 6/1997 | Meiselman | 36/115 |
| 5,671,939 | A | | 9/1997 | Pineau | 280/602 |
| 5,915,721 | A | * | 6/1999 | Laughlin et al. | 280/617 |
| 6,189,911 | B1 | * | 2/2001 | Caron et al. | 280/607 |
| 6,338,497 | B1 | * | 1/2002 | Chevalier et al. | 280/612 |
| 2003/0155744 | A1 | * | 8/2003 | Gorza et al. | 280/618 |

* cited by examiner 155
150
170
20
20
20
20
145
140
130
120
110

SKI BINDING

BACKGROUND OF THE INVENTION

1. Field of the Invention

The present invention relates to a safety binding for interfacing a ski boot to a ski or skiboard. A skiboard is defined as a ski with an overall length of 100 cm or less.

2. Discussion of the Related Art

Skiboards have been offered for sale with non-releasable bindings for several years. Non-releasable bindings were justified for use on skis under 100 cm due to the reasonable belief that the limited length of the ski would limit loads on the skier's leg to safe levels. Recently available statistics now show that injuries to skiboarders, although not largely disproportionate to the overall injury rate among skiers, show a disproportionate number of the injuries to the lower leg. These injuries include spiral fractures of the tibia, a very common injury to skiers before the availability of well engineered releasable safety bindings for skis in the 1970's and 1980's. The development of releasable safety bindings for skis has practically eliminated lower leg fractures and therefore appropriately designed releasable safety bindings can reasonably be expected to practically eliminate the lower leg fractures seen among skiboarders.

Conventional safety bindings for skis are not suitable for use on ski boards or other short skis for a variety of reasons:

a. They are generally too long. The release mechanism is generally located in front of the toe and behind the heel of the boot. The running length of a skiboard is typically 65 cm. A boot/binding system is typically 60 cm.

b. The thickness required by the skiboard design will not allow enough thickness for the typical attachment screws that hold the toe piece and heel pieces to the ski.

c. The desirable flexibility of the extremities of the skiboard would compromise the function of conventional bindings that depend on the very stiff and stable platform typical of conventional skis and described by ASTM and ISO standards for compatibility.

d. Skiboards do not and probably cannot be reasonably designed to conform to the ASTM and ISO standards for binding mounting areas on skis. These standards were developed to make ski designs compatible with conventional binding designs.

Furthermore, since the basic configuration of safety bindings was developed in the 70's and 80's, when skiboards and very short adult skis did not exist, there is an opportunity to eliminate some of the design limitations and flaws that have been perpetuated by the various binding manufacturer.

Current trends in ski design are towards much shorter ski lengths. Even skis used by elite world-class racers are often less than 160 cm in length, with running lengths less than 135 cm. The binding mounting area controlled by ASTM and ISO compatibility standards is 60 cm long. That is approximately 45% of the running length of a 160 cm ski. Compromises must be made in order to design these short skis to conform to ASTM and ISO standards intended to assure compatibility with the various bindings on the market. If a binding could be designed to eliminate or reduce the constraints imposed by conventional binding designs then ski design could be advanced to a new performance level. There have in the past been some efforts to create bindings which would not impair the ability of a ski to flex, such as U.S. Pat. No. 5,129,668 (Hecht) and U.S. Pat. No. 5,671,939 (Pineau) both of which describe a system in which a mounting is provided for the ski binding, said mounting creating a raised surface for the binding while allowing the ski to flex to a full arc. These mounting however add to both the cost and the complexity of a binding since an entirely new part is added.

Mounting conventional bindings is a complex procedure that is normally done by certified professionals employed by ski shops and trained by specialists. If a binding could be designed to mount to metal inserts built into a ski in a standard insert pattern with machine screws then this complexity can be eliminated. This is the norm in the snowboard industry where bindings can be simply mounted by the consumer with nothing more than a Phillips screwdriver.

Controlling the effects of boot/binding friction on binding performance is one of the most, difficult factors of binding design. Shortcomings in how friction has been dealt with by designers of conventional bindings makes the adjustment of the binding to the boot, and confirmation that such adjustments will produce the desired release characteristics, a very complex task that is normally performed by certified professionals. This is due to the fact that most of the friction between the boot and the binding is not "sensed" by the release mechanism of the binding. Therefore, any variation in frictional forces produces a variation in release torque. The person adjusting the binding must understand this relationship to properly adjust the binding.

If a binding could be designed with a sensing mechanism that senses all the forces between the boot and the binding that result in a torque on the tibia then friction would not have to be controlled within very strict limits. Frictional loads would only have to be held below a value that is in the range of normal friction between a typical shoe sole and the ground since humans have evolved the strength to withstand such forces. All fictional forces not seen by the release mechanism would be contained within the binding mechanism and therefore would be subject to the control of the design engineers and of no concern to the person mounting and adjusting the binding. Boot binding adjustment would not be critical to binding performance and could potentially be undertaken by the consumer.

One solution which has been used in trying to solve this problem in the past are plate bindings. Plate bindings of various types have a plate which is either formed integral with the binding, U.S. Pat. No. 4,052,086 (Eckhart), U.S. Pat. No. 5,240,275 (Jungkind), U.S. Pat. No. 5,044,657 (Freisinger et al.), U.S. Pat. No. 4,893,831 (Pascal et al.), U.S. Pat. No. 4,892,326 (Svoboda et al.), U.S. Pat. No. 4,314,714 (Gertsch), and U.S. Pat. No. 4,073,509 (Gertsch) being examples of this type; or having a detachable plate which is fastened to the ski boot, as in U.S. Pat. No. 5,145,202 (Miller), U.S. Pat. No. 5,044,654 (Meyer), U.S. Pat. No. 4,395,055 (Teague, Jr.), U.S. Pat. No. 4,185,851 and U.S. Pat. No. 3,944,237. In both of these types of binding the designer attempts to take the unknown friction between the boot and the binding out of the picture by having the boot be fixed to a plate and leaving only a known friction between the plate and the binding.

Conventional bindings release by sensing a lateral force at the toe of the boot and cannot differentiate between loads at the tip of the ski and loads at the tail of the ski that produce the same torque about the tibial axis. For example, a release caused by a force on the lateral (outside) edge of the ski 70 cm in front of the tibial axis will subject the tibia and connective tissues to same torque but opposite shear load than if the same load where applied to the medial (inside) edge 70 cm behind the tibial axis. It is believed by many knowledgeable in the art of ski binding design and ski injury analysis that Anterior Cruciate Ligament (ACL) injuries to the knee are often caused by a load to the medial (inside)

edge of the tail of the ski. This kind of load causes an abduction and inward twisting of the lower leg. If a binding could be designed that could differentiate between loads applied at the tip of the ski, outward twisting loads applied at the lateral side of the ski tail and inward twisting loads applied at the medial side the ski tail it may have the potential to afford skiers significant additional protection against ACL injuries that conventional bindings cannot provide.

SUMMARY OF THE INVENTION

It is an object of the present invention to provide an improved ski binding that addresses, but is not limited to addressing the above issues, and to provide a safety binding for interfacing a ski boot to a ski or skiboard. As previously explained, a skiboard is defined as a ski with an overall length of 100 cm or less. The safety binding in question saving a base plate which in the preferred embodiment of the invention is shorter than a conventional ski binding and which can be mounted on standard inserts built into the ski. The connection with the ski itself is located centrally on the binding and once mounted the base plate is raised slightly above the surface of the ski. Thus the binding does not require the same flat surface area as a conventional binding, and the normal flexibility of the ski is not hindered by the binding.

Mounted on the base plate is a top plate which is pivotable in a lateral direction. The top plate is biased towards a predetermined position. Mounted on the top plate are means for holding a ski boot in place. The mounting is such that any pivoting movement of the top plate will result in at least one of the holding means being pivoted or otherwise moved. This pivoting or movement will cause the holding means to release. The heel is also designed to release with conventional means. While in the binding, the boot rests on a toe pad and a heel pad. These pads are connected to the top plate such that any torque on the boot is transferred through these pads to the top plate. If the force is sufficient to overcome the bias on the top plate then it pivots, and the boot is released. After the boot is released, the bias on the top plate returns it to its normal state. The heel portion of the binding can also be outfitted with a conventional ski brake to prevent the ski from sliding away in the case of a release.

In accordance a first (FIG. 3) illustrative embodiment of the invention, a ski binding is provided for securing a ski boot to a ski. The binding comprises a base, two elongated plates pivotably attached to the base near its centroid, a toe cup and a heel cup rotatably attached to the elongated plates. The two elongated plates, the toe cup, and the heel cup are pivotably attached to each other in a parallelogram arrangement. The elongated plates are biased by a spring and cam to have their longitudinal axis aligned with the longitudinal axis of the ski. The toe and heel cups constrain the ski boot substantially parallel to the elongated plates. Any torque applied to the ski boot is transmitted through the toe and heel cups to the elongated plates. At a prescribed load, the elongated plates rotate from their biased positions and the parallelogram arrangement skews causing the tone and heel cups to rotate such that the boot is free to release from the binding.

In a accordance with a second (FIG. 4) illustrative embodiment of the invention, a ski binding is provided that comprises a base, a rigid plate pivotably attached to the base near its centroid, a toe and heel cup pivotably attached near the extremities of the rigid plate, one or more connecting rods pivotably attached to the base and pivotably attached to a separate point on the toe and/or heel cup. The rigid plate is biased by a spring such that its longitudinal axis is aligned with the longitudinal axis of the ski. The toe and heel cups constrain the ski boot substantially parallel to the rigid plate. Any torque applied to the ski boot is transmitted through the toe and heel cups to the rigid plate. At a prescribed load the rigid plate rotates from its biased position and the connecting rod(s) cause the toe and heel cups to rotate such that the boot is free to release from the binding.

In accordance with a third illustrative embodiment of the invention, a ski binding is provided that comprises a base, a rigid plate pivotably attached to the base near its centroid, a toe and heel cup slidably attached near the extremities of the rigid plate, one or more connecting rods attached at one end to the toe and/or heel cup(s) and at the other end connected or in contact with a link or cam surface on the base so that any rotational moment, from the boot through the toe and heel cups, that overcomes the biased alignment of the rigid plate causes the connecting rod(s) to translate the toe and/or heel cup(s) away from the boot in such a way that the boot free to release from the binding.

In accordance with a fourth (FIG. 5) illustrative embodiment of the invention, a ski binding is provided that comprises an elongated base plate, all elongated rigid plate pivotably attached to the base near its centroid, a toe and/or heel cup pivotably attached to both the elongated base plate and the pivotable rigid plate at separated points. Any rotational moment applied to the boot and transmitted to the toe and heel cups that overcomes the biased alignment of the pivotable plate and causes the pivotable plate to move relative to the base plate will cause the toe and/or heel cup(s) to rotate or translate in such a way that the boot is free to release from the binding. The biased alignment of the pivotable plate is maintained by a double spring/cam arrangement having two springs which are attached to pins which connect with four distinct cam surfaces. The cam surfaces are attached to the pivoting plate in opposing positions. By altering the cam surfaces it is possible to have a different bias for the directions in which the pivoting plate can pivot.

A BRIEF DESCRIPTION OF THE DRAWINGS

The invention will be better understood and appreciated from following the description of illustrative embodiments thereof, and accompanying drawings, in which.

DESCRIPTION OF PREFERRED EMBODIMENTS

The invention will be better understood in the following detailed description of the preferred embodiments with reference to the drawings.

Figure 1:
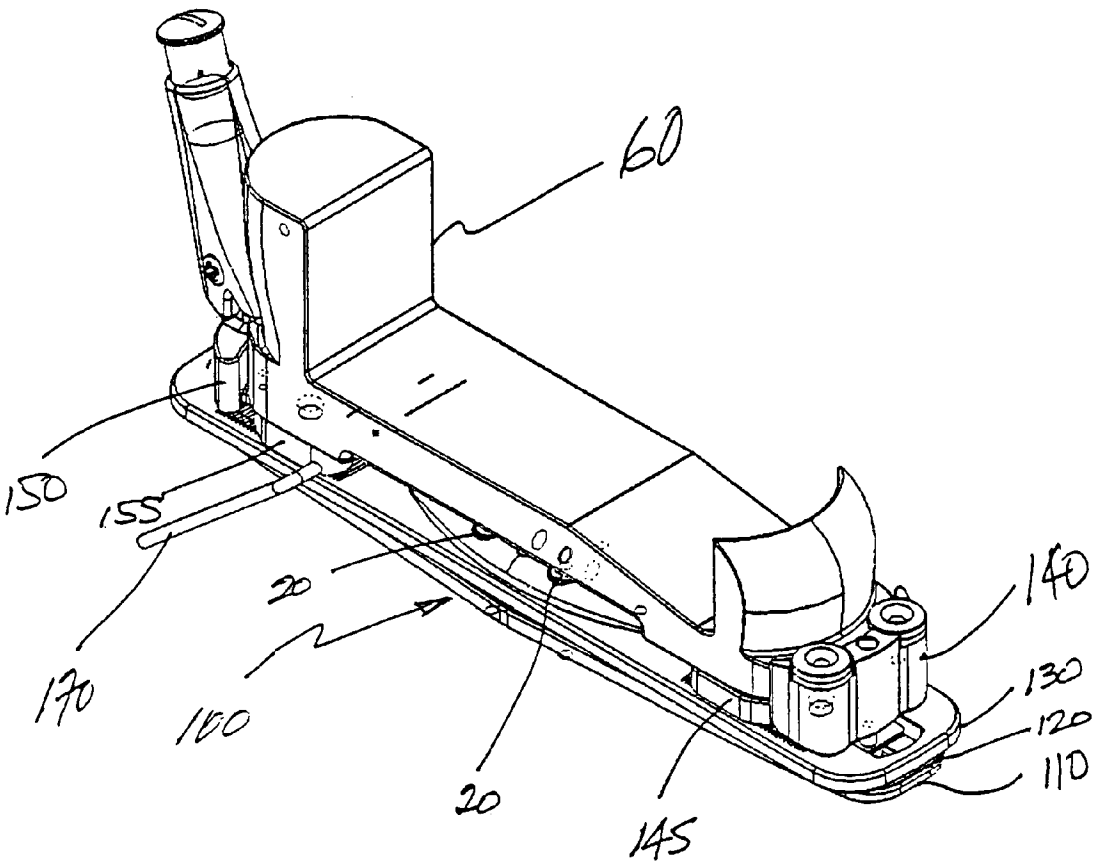
FIG. 1 is a perspective view of one embodiment of the invention with a boot, mounted oil a typical skiboard.
Figure 1A:
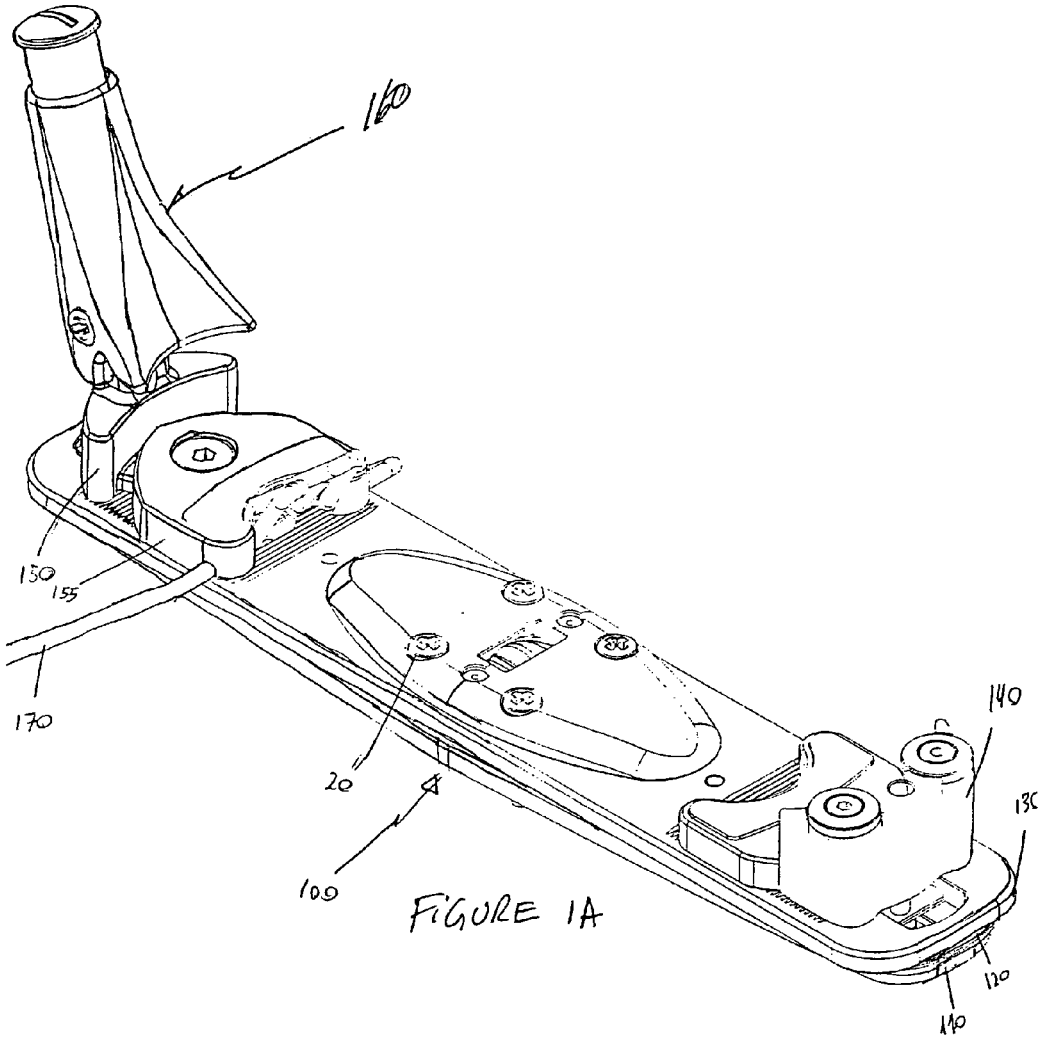
FIG. 1A is a perspective view of the embodiment shown in FIG. 1, without the boot.
Figure 2:
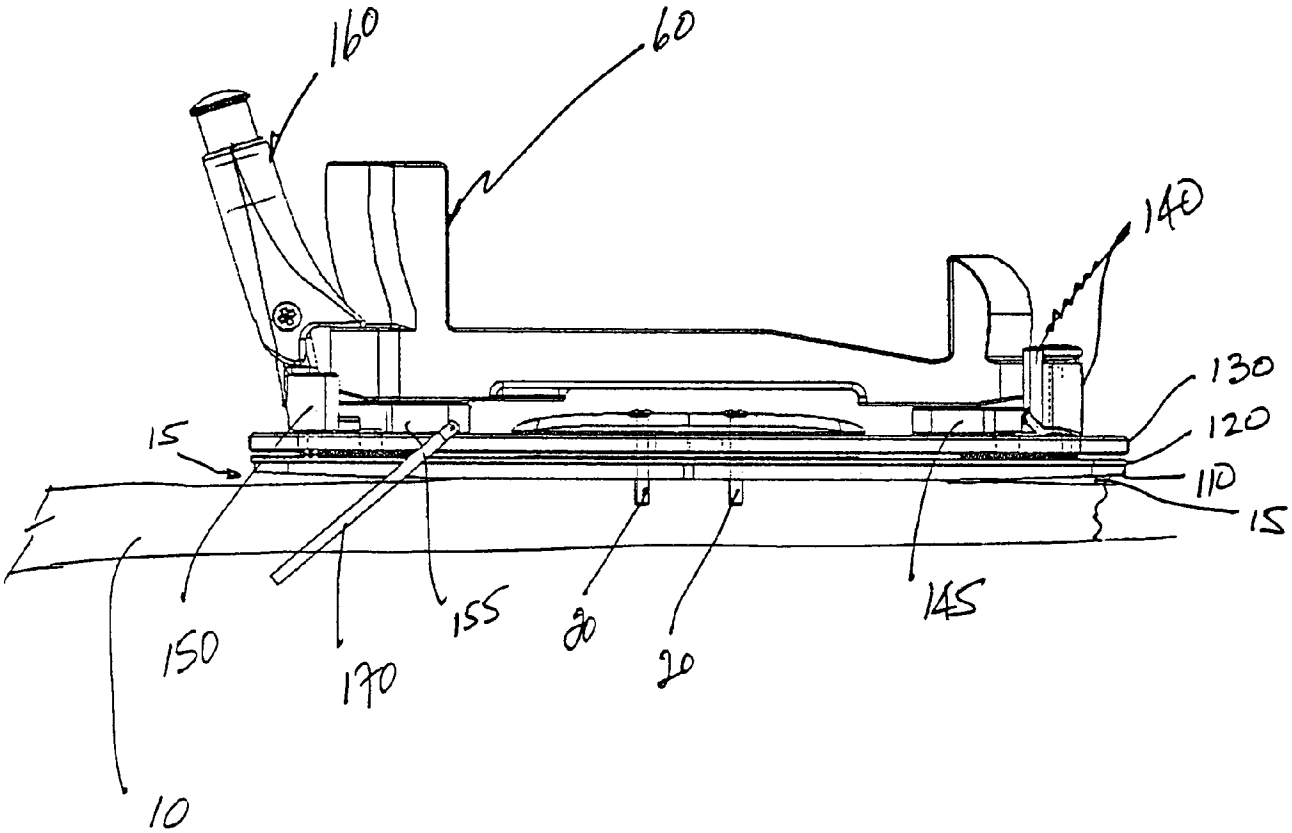
FIG. 2 is a side view of the embodiment shown in FIG. 1.
Figure 5:
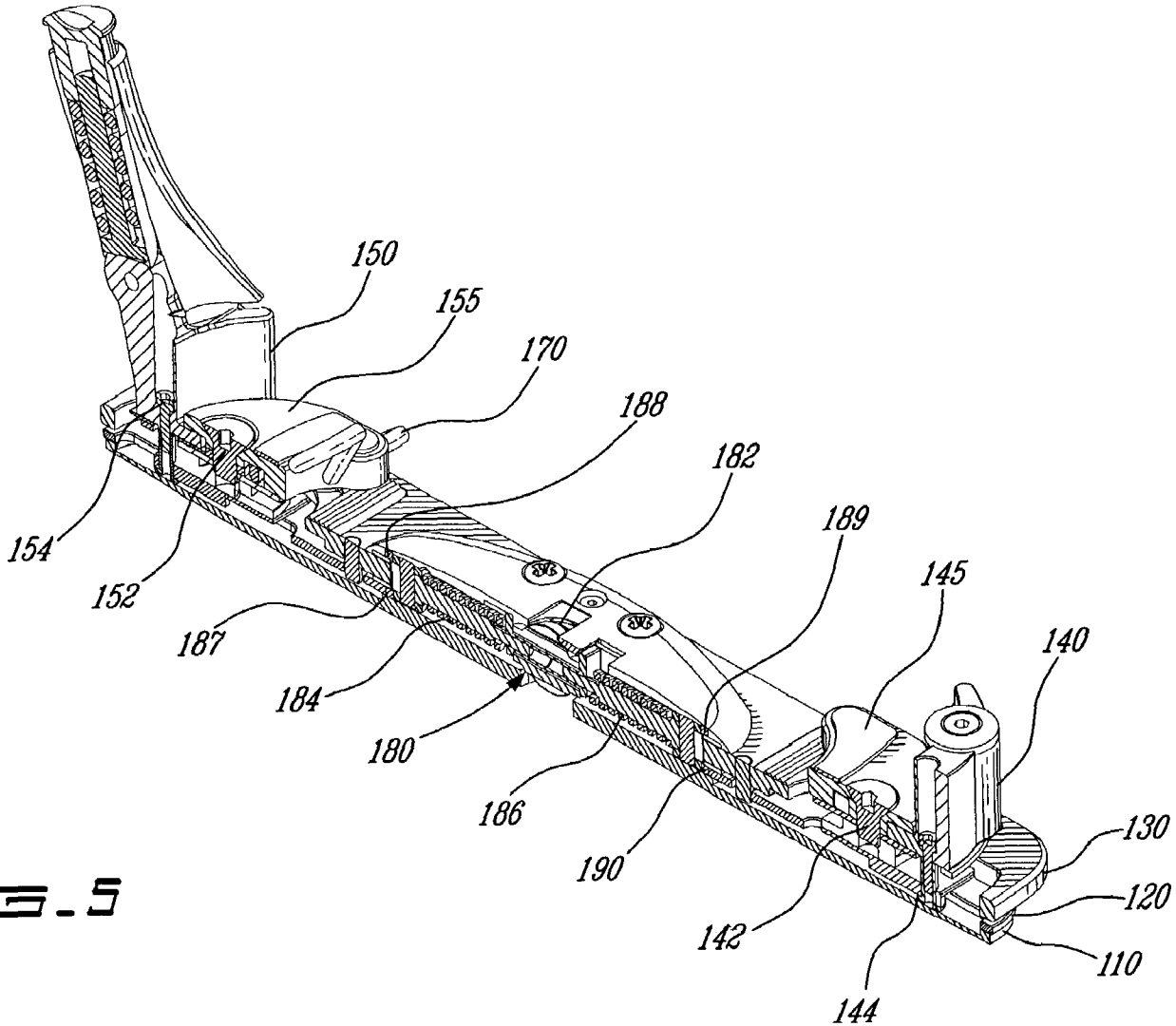
FIG. 5 is a perspective cross-sectional view the embodiment of the invention described in FIG. 1.
Figure 6:
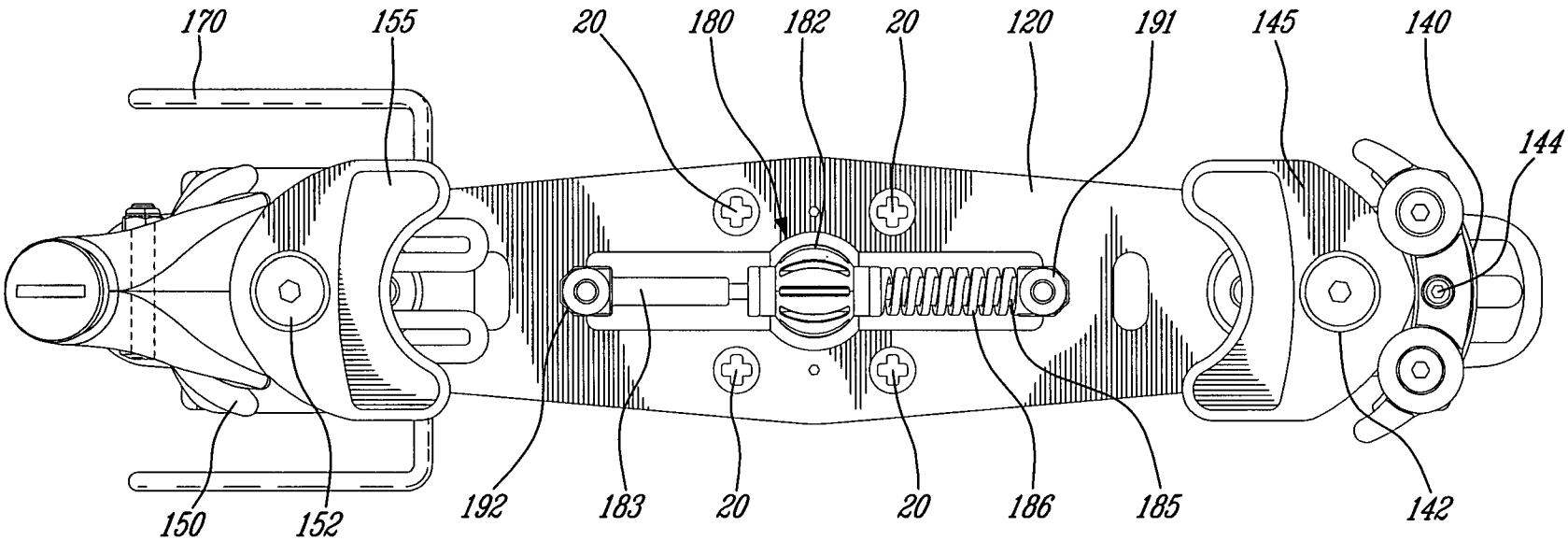
FIG. 6 is a top view of the embodiment shown in FIG. 1 with some components removed from view, showing the elongated base plate and spring biasing means.
Figure 6A:
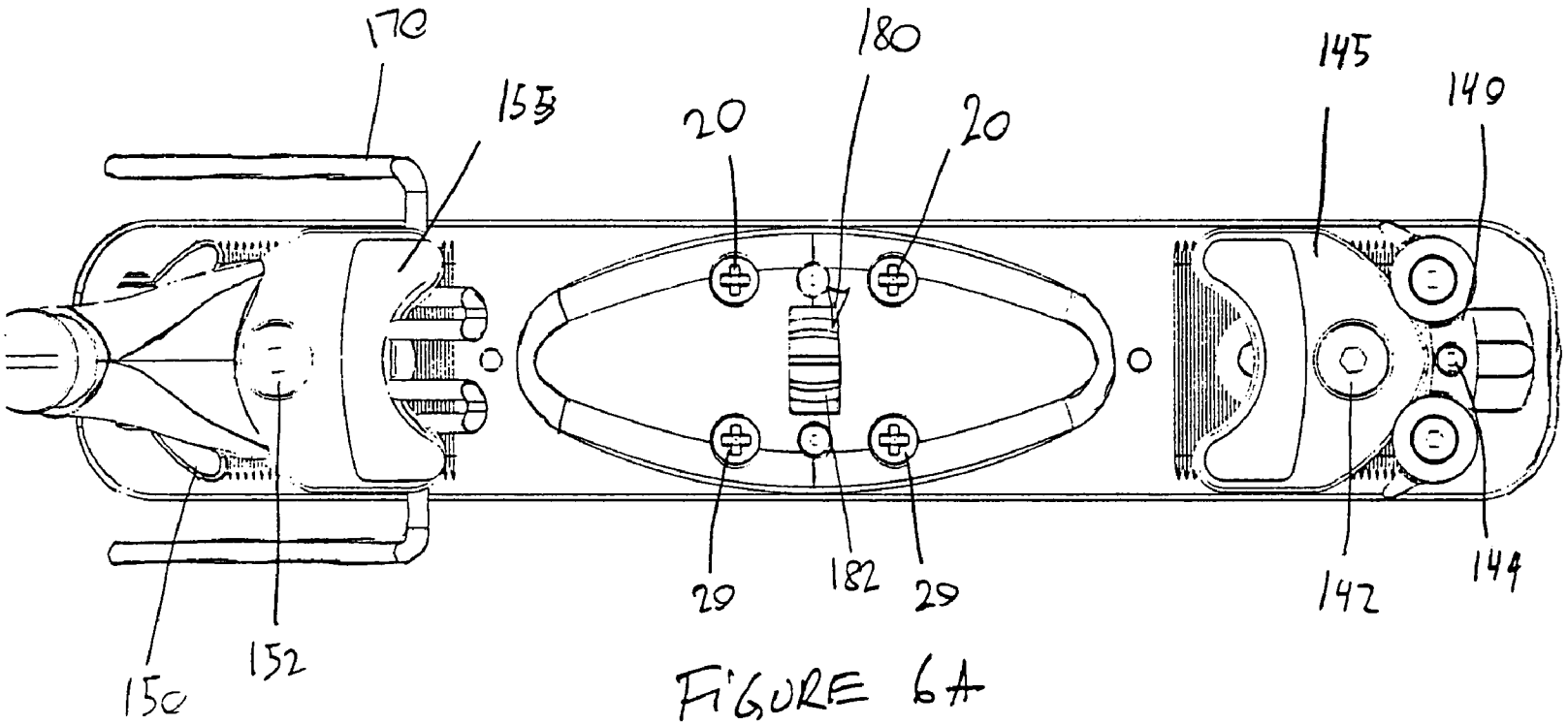
FIG. 6A is a top view of the embodiment shown in FIG. 1A.

FIGS. 1 and 2 show the preferred embodiment of the invention. In this embodiment the binding 100 is mounted on a ski 10. The binding is separated from the ski by a bottom pad 110, which allows the ski to flex and makes sure that the ski is not harmed by the binding when flexing. Resting on the bottom pad 110 is a static base plate 120. The central area of the static base plate 120, contains the biasing means 180 (shown in FIGS. 5 and 6), which hold top plate 130 in its normal position. Top plate 130 is mounted on top of the static base plate 120 in such a way that the top plate 130 can pivot laterally around the biasing means 180. Mounted on the top plate 130 are the heel holding cup 150 and the toe holding cup 140. These cups work to hold a boot (shown schematically as 60) to the binding. The heel cup 150 is also fitted with conventional boot release means 160. The boot 60 rests on the heel pad 155, and the toe pad 145. These pads are mounted on the top plate 130 such that any torque applied to the boot 60 is transmitted to the top plate 130. The heel pad 155, is fitted with a conventional ski brake 170 which prevents the ski from sliding away in the case of a release of the boot 60.

As seen in FIG. 2, the binding 100 is fastened to the ski 10 by screws 20 in a central location. The binding 100 is separated from the ski 10 by the bottom pad 110, which tapers off towards the extremities of the binding to create spaces 15 or alternatively is sufficiently soft towards the extremities to deflect or compress to create spaces. The existence of spaces 15 allows for the ski to flex without being hindered by the binding.

Figure 3:
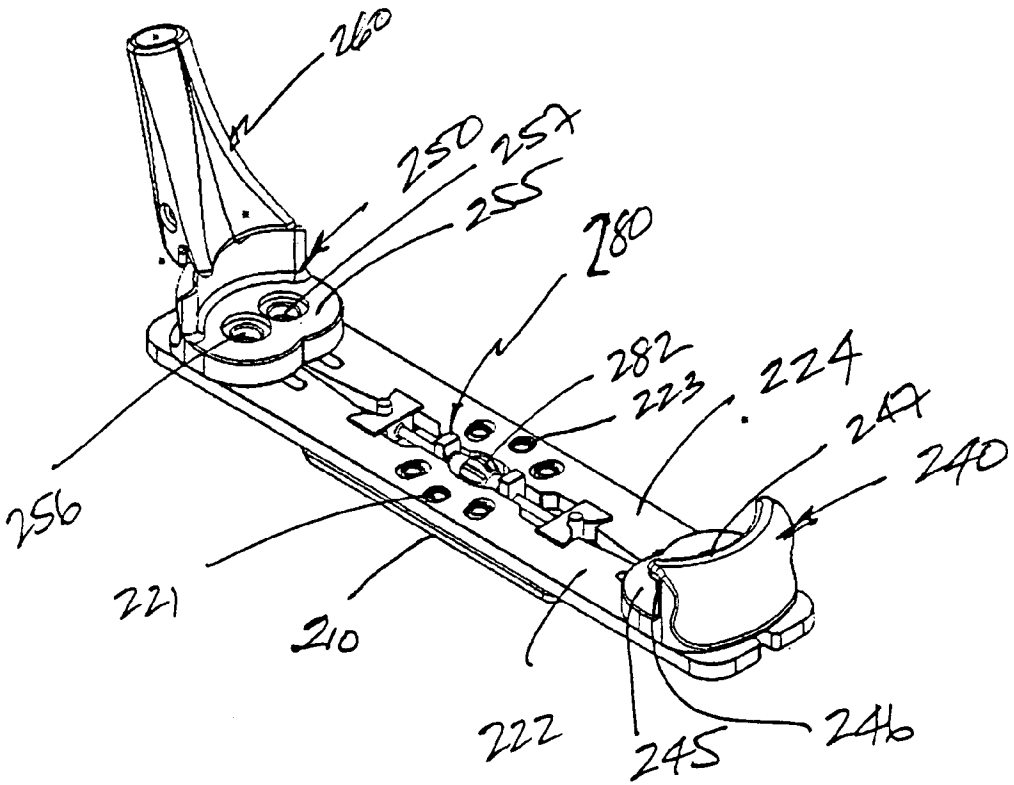
FIG. 3 is a perspective view of a second embodiment of the invention from which certain components have been removed.

FIG. 3 shows another embodiment of the invention. In this embodiment the invention has a base pad 210 which attaches to the ski (not shown). Mounted on top of the base pad 210 are two elongated plates 222 and 224 which can pivot laterally about their centroid 221 and 223. The plates 222 and 224 are biased towards being aligned with the ski, by the biasing mechanism 280. This mechanism is adjustable to give a greater or lesser bias by wheel 282. Mounted on top of the plates 222 and 224 are the toe cup 240 and the heel cup 250. In this embodiment the toe cup 240 and the heel cup 250 are integrally formed with a'toe pad 245 and a heel pad 255. Each of the toe pad 245 and the heel pad 255 are pivotally connected to both elongated plates 222 and 224 at points 246, 247, 256 and 257. A boot (not shown) rests on the toe pad 245 and the heel pad 255, such that torsional forces (about a vertical axis) on the boot cause frictional and/or impingment forces to be applied by the boot to the toe pad 245 and to the heel pad 255. These forces are transferred to the plates 222 and 224. If the force is sufficiently large to overcome the bias created by the biasing mechanism 280, then the plates 222 and 224 will pivot laterally, thus being displaced with respect to each other. This displacement causes the toe cup 245 and the heel cup 255 to be pivoted thereby releasing their hold on a boot.

Figure 4:
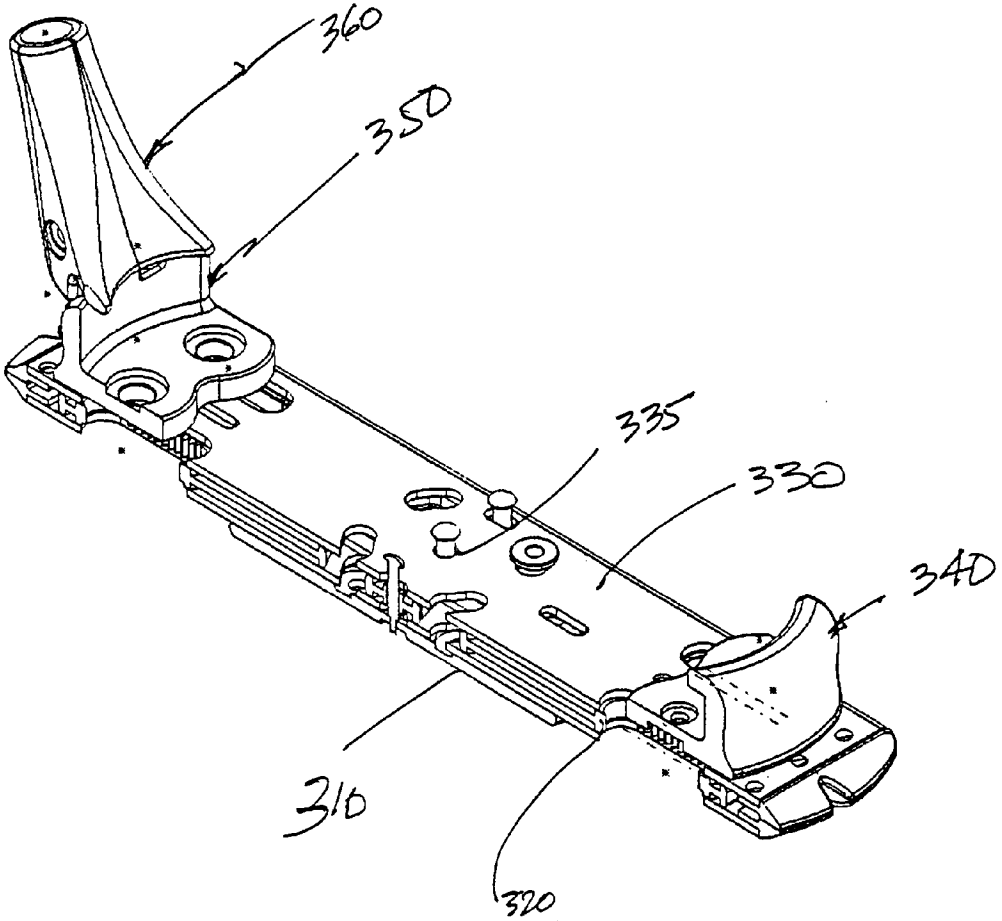
FIG. 4 is a perspective cross-sectional view of a third embodiment of the invention from which certain components have been removed.

FIG. 4. shows still another embodiment of the invention. In this embodiment we have a base pad 310, on top of which is pivotably mounted a top plate 330. A spring (not shown) gives the top plate 330 a bias towards being aligned with the ski (not shown). Mounted over the top plate 330 are toe cup 340 and heel cup 350, both of which are pivotable about a vertical axis. The toe cup and heel cup are pivotably attached to the top plate 330 such that any torsional force about a vertical axis affecting a boot held between the toe cup 340 and the heel cup 350 will cause the top plate 330 to pivot about its centroid 335. The toe cup 340 and the heel cup 350 are further attached to connecting rods 320 which are situated within the top plate 330. If a torsional force is created on a boot secured in the binding, is great enough to overcome the bias in the top plate 330, then the top plate 330 will pivot laterally causing the connecting rods 320 to move and thereby rotating the toe cup 340 and the heel cup 350 to a release position. After the boot has been released the bias in the top plate will return the top plate to is neutral position.

FIGS. 5, 5A, 5B, and 6 clearly show the insides of the biasing means 180, which is responsible for giving the top plate 130 its predetermined bias. The biasing means 180, consists of an adjustor 182, which can be used to adjust the force needed to overcome the bias, and two springs 184 and 186 which are connected to the top plate 130 to give it its bias. These figures also show the fastening means 142 and 152 by which the heel pad 155 and the toe pad 145 are connected to the top plate 130. It is through these that the torsional force on the boot is transferred to the top plate 130. Also shown are the connecting means 144 and 154 which hold the toe cup 140 and the heel cup 150 to the base plate. It is through these two different connections that the toe cup 140 and the heel cup 150 are caused to pivot or translate during release. We also see the bias pins 183 and 185 which are connected to the springs 184 and 186 and the top plate by the way of cam surfaces 187, 188, 189, and 190 which are in contact with front cam roller 191 and rear cam roller 192.

Figure 5A:
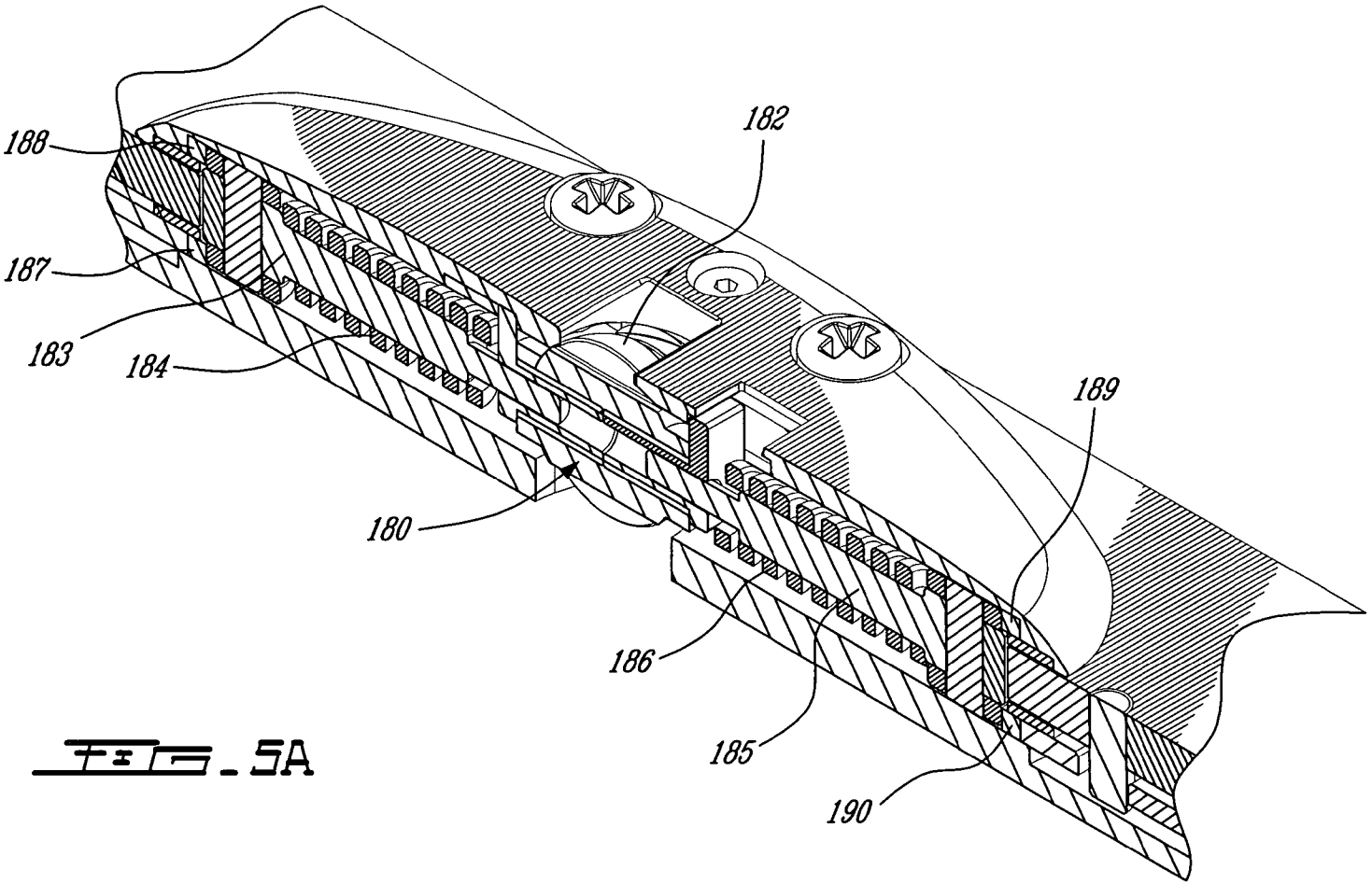
FIG. 5A is a closeup of the biasing means shown in FIG. 5.
Figure 5B:
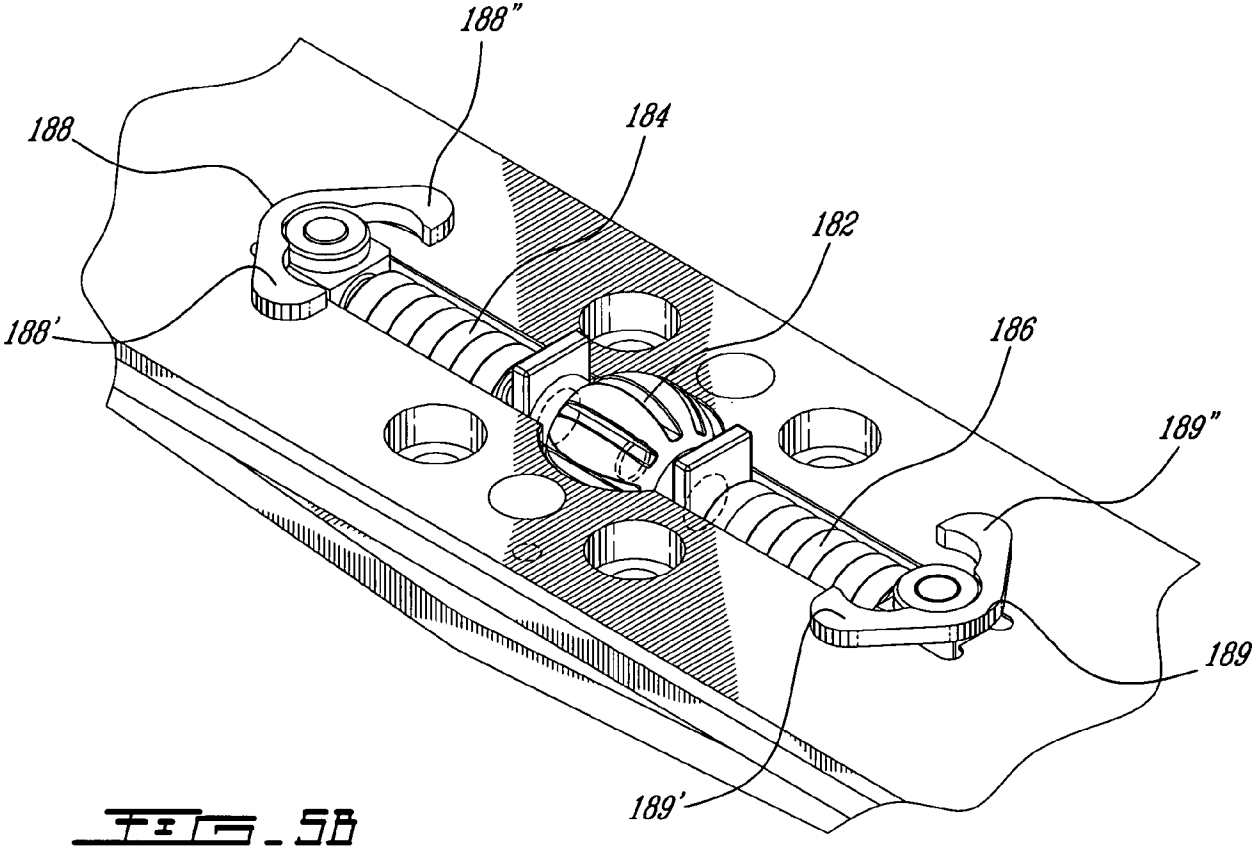
FIG. 5B is a perspective view of the embodiment of the invention described in FIG. 1 from which certain components have been removed.
Figure 7:
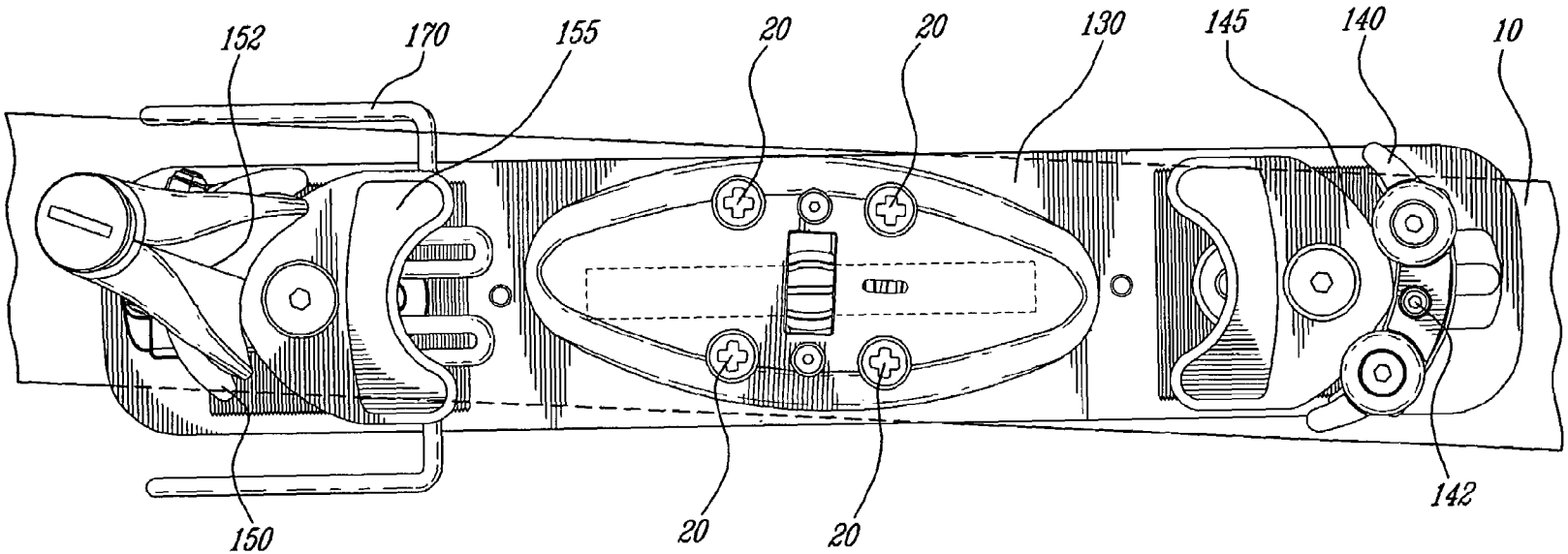
FIG. 7 is a top view of the embodiment show in FIG. 1 in an open position, without the boot

By properly designing the cam surfaces 187, 188, 189, and 190 it is possible to obtain a ski binding in which the ski boot will be released more easily if a load is applied to the medial (inside) edge of the tail of the ski than if a similar load is applied to the lateral (outside) edge of the front of the ski. For instance, FIGS. 5A, 5B and 7 illustrate the event when a rotational moment induced by a force applied to the ski boot is transmitted to the toe and heel cups 140, 150 and overcomes the biased alignment of the top plate 130. This event causes the top plate 130 to move relative to the base plate 120 and also causes the toe and/or heel cup(s) 140, 150 to rotate or translate in such a way that the boot is free to be released from the binding. Each cam surface 187, 188, 189, and 190 comprises lateral sides 188", 189" and are attached to the top plate 130. By altering the cam surfaces 187, 188, 189, and 190, it is possible to have a different bias for the directions in which the top plate can pivot.

FIG. 7 shows and top view of the preferred embodiment of the invention in an open configuration. In this figure we can see how a twisting load on the forebody of the ski affects the top plate 130. The top plate 130 pivots in a counter-clockwise direction about the rear cam roller 192, the toe cup 140 and the heel cup 150 are pivoted in a clockwise direction about connecting means 142 and 152, thereby releasing the boot. Alternatively, if the twisting load is applied to the tail of the ski the top plate pivots about the front cam roller 191.

Figure 8:
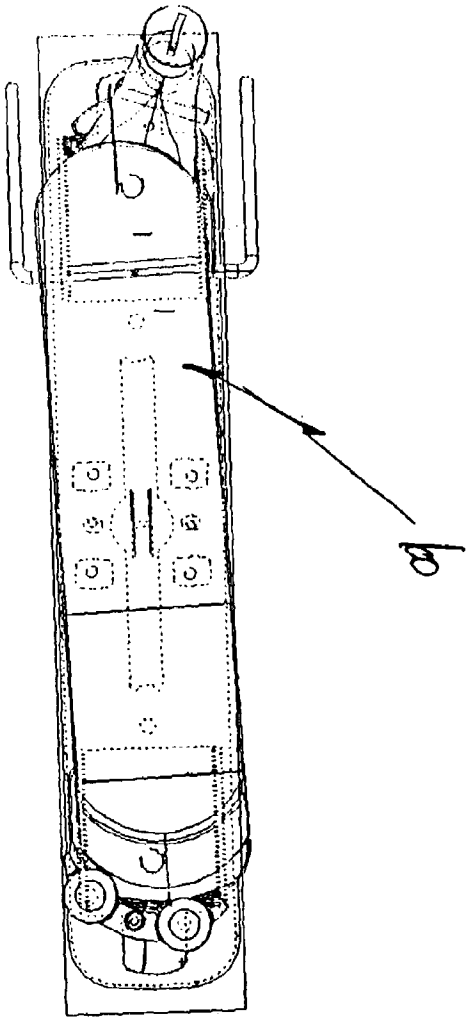
FIG. 8 is a top view of the embodiment shown in FIG. 1 in an open position with a ski boot superimposed.
Figure 9:
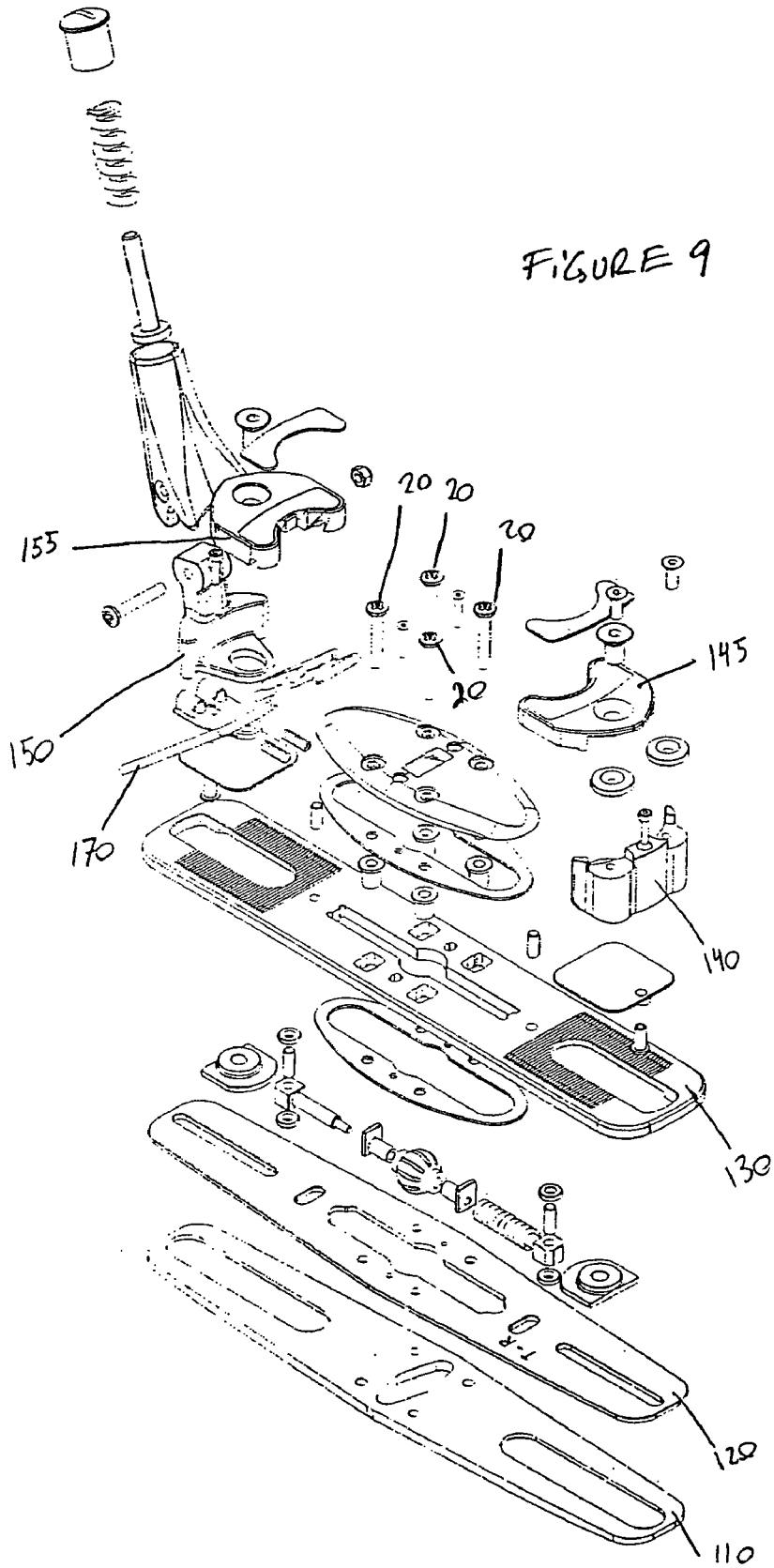
FIG. 9 is an exploded view of the embodiment shown in FIG. 1.
Figure 10:
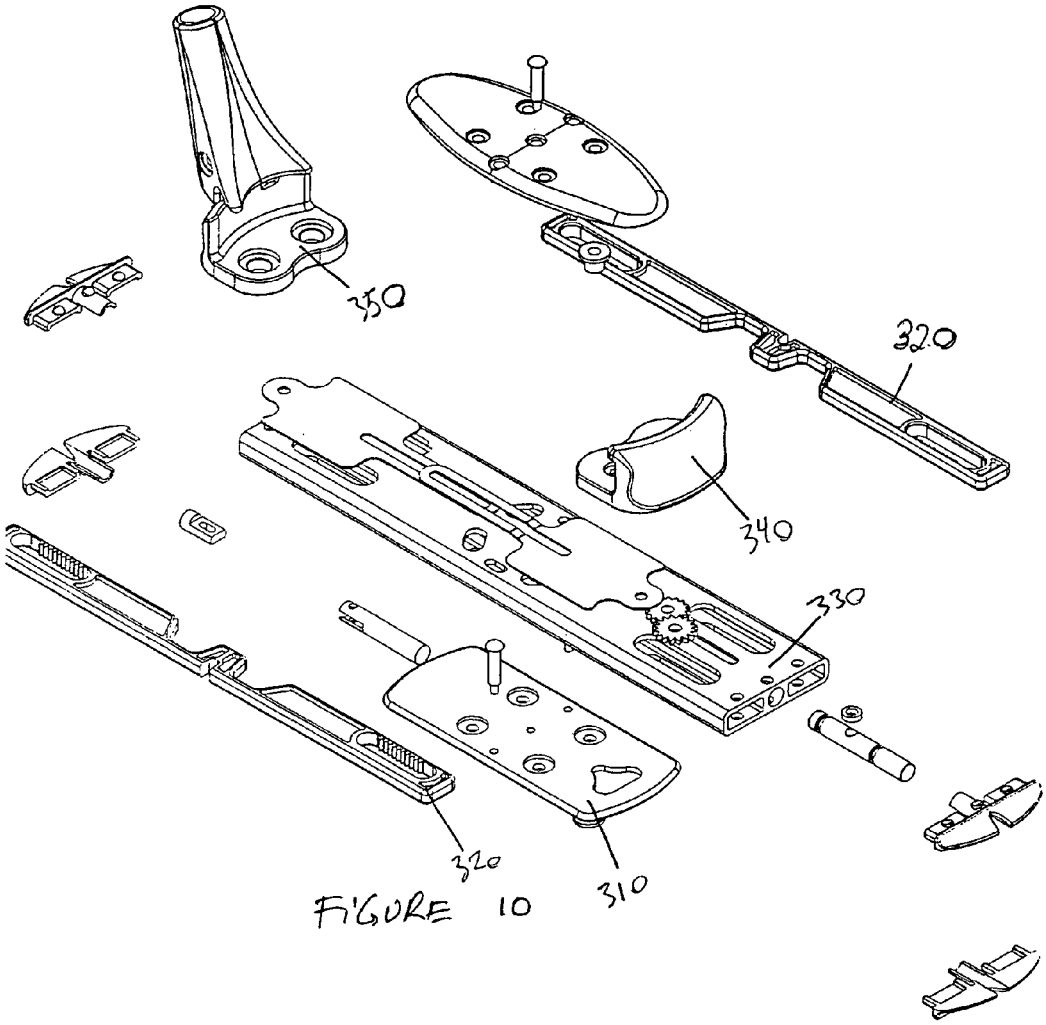
FIG. 10 is an exploded view of the embodiment shown in FIG. 4.
Figure 11:
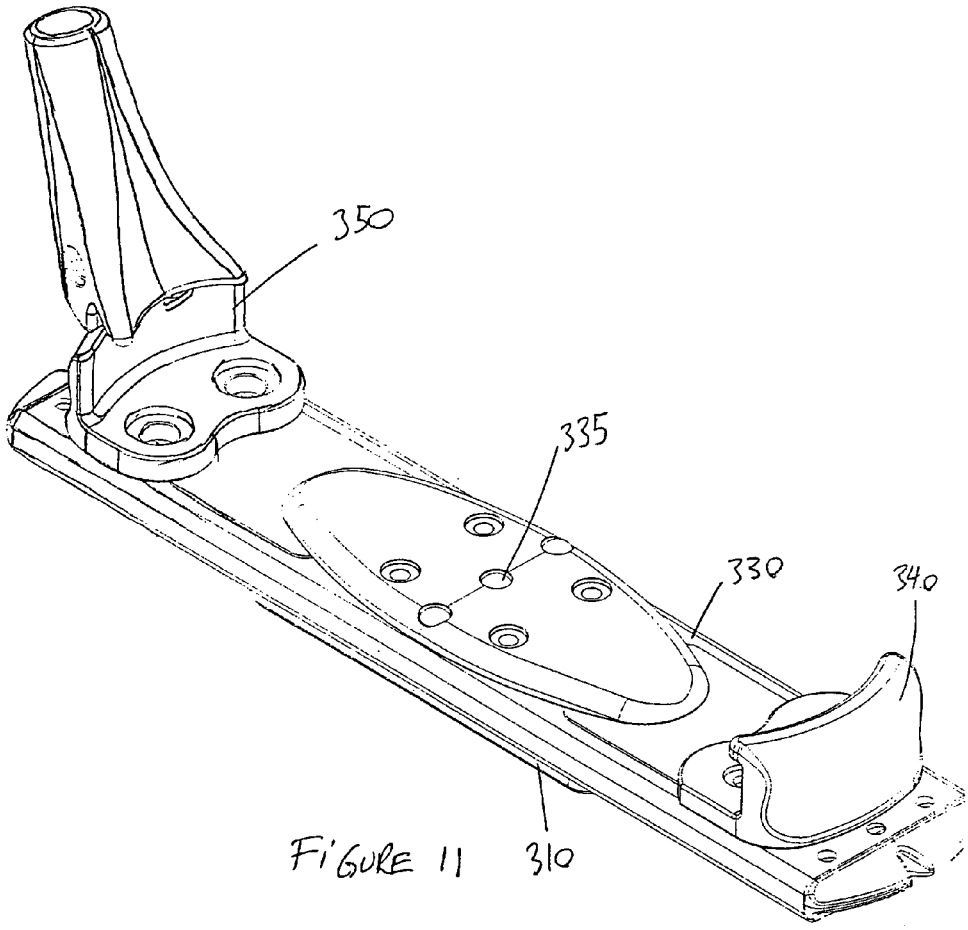
FIG. 11 is a perspective view of the embodiment shown in FIG. 4.

FIG. 8. shows the same configuration as FIG. 7. only this time with a boot 60 superimposed to show how the toe cup 140 and the heel cup 150 release the boot as they pivot.

It will be apparent to those skilled in the art that several modifications and variations not mentioned exists. Accordingly the previous descriptions are only meant for the purposes of illustration, and are not meant to limit the scope of the invention.

The invention claimed is:

1. A ski binding for a ski comprising:

a rigid static base plate;

a top plate pivotally attached to the static base plate;

a toe holding means pivotally mounted to said top plate so that said toe holding means can pivot around a vertical axis;

a heel holding means mounted on said top plate;

a means to mount said static base plate on said ski at or near a longitudinal center of said static base plate;

a first pivot means located between said center and said toe holding means adapted to allow said top plate to pivot around said first pivot means.

2. The ski binding as claimed in claim 1, further comprising second pivot means located between said center and said heel holding means adapted to allow said top plate to pivot around said second pivot means.

3. The ski binding as claimed in claim 2 wherein said heel holding means are pivotally mounted to said top plate so that said heel holding means can pivot around a vertical axis.

4. A ski binding comprising:

a static base plate capable of being fixedly attached to a ski or ski board;

a top plate moveably attached to the static base plate in a manner that permits pivotal movement of generally said entire top plate around a vertical axis;

a biasing means, for biasing the top plate towards a predetermined position;

a toe holding means having first vertical pivot means connected to the said base plate and second vertical pivot means connected to the said top plate such that said toe holding means can pivot around said first vertical pivot means; and a heel holding means having third vertical pivot means connected to the said base plate and fourth vertical pivot means connected to the said top plate such that said heel holding means can pivot around said third vertical pivot means when a lateral force is applied to the heel portion of a boot causing lateral displacement of said top plate from the predetermined position and the release of the boot.

5. A ski binding comprising:

a static base plate capable of being fixedly attached to a ski or ski board;

a top plate moveably attached to the static base plate in a manner that permits pivotal movement of generally said entire top plate around a vertical axis;

a first and second pivoting means, coupled to said top plate, said first pivoting means disposed forward of a central point along a longitudinal axis of said top plate proximate a toe holding region on said top plate, said second pivoting means disposed rearward of said central point along a longitudinal axis of said top plate proximate a heel holding region on said top plate, said first and second pivoting means for allowing said toe holding region of said top plate to move generally laterally in a first direction and said second pivoting means for allowing said heel holding region of said top plate to move generally laterally in a second direction opposite said first direction;

a biasing means, coupled to said first and second pivoting means, for biasing the top plate towards a predetermined position;

a toe holding means having first vertical pivot means connected to the said base plate and second vertical pivot means connected to the said top plate such that said toe holding means can pivot around said first vertical pivot means when a lateral force is applied to the toe portion of the boot causing lateral displacement of said top plate from the predetermined position and the release of a boot; and a heel holding means, pivotally connected to the top plate proximate said heel holding region such that said heel holding means can pivot around a vertical axis, and wherein a lateral force applied to the heel holding means is transferred to the top plate causing lateral displacement of said top plate from the predetermined position.

6. A safety ski binding for releasably securing a boot having a toe portion and a heel portion to a ski or a ski board comprising:

a static base plate capable of being fixedly attached to said ski or ski board;

a top plate pivotally attached to the static base plate in a manner that permits pivotal movement of generally said entire top plate around a vertical axis;

a biasing means for biasing the top plate towards a predetermined position, said biasing means comprising a laterally pivoting biasing means having a first laterally displacing cam and a second laterally displacing cam wherein said first laterally displacing cam comprises a first bias which pivotally cooperates with said top plate and said second laterally displacing cam comprises a second bias which pivotally cooperates with said top plate, said first bias being different than said second bias; and a toe holding means having first vertical pivot means connected to the said base plate and second vertical pivot means connected to the said top plate such that said toe holding means can pivot around said first vertical pivot means when a lateral force is applied to the toe portion of the boot causing lateral displacement of said top plate from the predetermined position and the release of the boot.

7. A safety ski binding for releasably securing a boot having a toe portion and a heel portion to a ski or a ski board comprising:

a static base plate capable of being fixedly attached to said ski or ski board;

a top plate pivotally attached to the static base plate in a manner that permits pivotal movement of generally said entire top plate around a vertical axis;

a biasing means for biasing the top plate towards a predetermined position, said biasing means comprising a laterally pivoting biasing means having a first laterally displacing cam wherein said first laterally displacing cam comprises a cam follower, a first cam surface on which said cam follower may laterally travel if a lateral force having a first direction is applied thereon and a second cam surface on which said cam follower may laterally travel if a lateral force having a second direction is applied thereon; and a toe holding means having first vertical pivot means connected to the said base plate and second vertical pivot means connected to the said top plate such that said toe holding means can pivot around said first vertical pivot means when a lateral force is applied to the toe portion of the boot causing lateral displacement of said top plate from the predetermined position and the release of the boot.

8. A safety ski binding for releasably securing a boot having a toe portion and a heel portion to a ski or a ski board comprising:

a static base plate capable of being fixedly attached to said ski or ski board;

a top plate pivotally attached to the static base plate in a manner that permits pivotal movement of generally said entire top plate around a vertical axis;

a biasing means for biasing the top plate towards a predetermined position, said biasing means comprising a laterally pivoting biasing means having a first laterally displacing cam and a second laterally displacing cam wherein said first laterally displacing cam comprises a first bias which pivotally cooperates with said top plate and said second laterally displacing cam comprises a second bias which pivotally cooperates with said top plate, said first bias being different than said second bias;

a toe holding means having first vertical pivot means connected to the said base plate and second vertical pivot means connected to the said top plate such that said toe holding means can pivot around said first vertical pivot means when a lateral force is applied to the toe portion of the boot causing lateral displacement of said top plate from the predetermined position and the release of the boot; and a heel holding means pivotally connected on said top plate such that said heel holding means can pivot around a vertical axis and so that a lateral force applied to the heel holding means is transferred to said top plate which will cause said heel holding means to pivot.

9. A safety ski binding for releasably securing a boot having a toe portion and a heel portion to a ski or a ski board comprising:

a static base plate capable of being fixedly attached to said ski or ski board;

a top plate pivotally attached to the static base plate in a manner that permits pivotal movement of generally said entire top plate around a vertical axis;

a biasing means for biasing the top plate towards a predetermined position, said biasing means comprising a laterally pivoting biasing means having a first laterally displacing cam wherein said first laterally displacing cam comprises a cam follower, a first cam surface on which said cam follower may laterally travel if a lateral force having a first direction is applied thereon and a second cam surface on which said cam follower may laterally travel if a lateral force having a second direction is applied thereon;

a toe holding means having first vertical pivot means connected to the said base plate and second vertical pivot means connected to the said top plate such that said toe holding means can pivot around said first vertical pivot means when a lateral force is applied to the toe portion of the boot causing lateral displacement of said top plate from the predetermined position and the release of the boot; and a heel holding means pivotally connected on the top plate such that said heel holding means can pivot around a vertical axis and so that a lateral force applied to the heel holding means is transferred to the top plate which will cause the heel holding means to pivot.

10. A ski binding for use with a ski or a ski board comprising:

a static base plate capable of being fixedly attached to said ski or ski board;

a top plate pivotally attached to the static base plate;

a laterally pivoting biasing means for biasing the top plate towards a predetermined position, said laterally pivoting biasing means comprising a first laterally displacing cam and a second laterally displacing cam wherein said first laterally displacing cam comprises a first bias which pivotally cooperates with said top plate and said second laterally displacing cam comprises a second bias which pivotally cooperates with said top plate, said first bias being different than said second bias; and a toe holding means translatably connected to the top plate so that lateral force applied to the toe holding means is transferred to the top plate, having toe safety release means which will release when the toe holding means is translated.

11. A ski binding as claimed in claim 10 wherein the static base plate is attached to the ski or ski board, in a central portion of the static base plate.

12. A ski binding for use with a ski or a ski board comprising:

a static base plate capable of being fixedly attached to said ski or ski board;

a top plate pivotally attached to the static base plate;

a laterally pivoting biasing means for biasing the top plate towards a predetermined position, said laterally pivoting biasing means comprising a first laterally displacing cam wherein said first laterally displacing cam comprises a cam follower, a first cam surface on which said cam follower may laterally travel if a lateral force having a first direction is applied thereon and a second cam surface on which said cam follower may laterally travel if a lateral force having a second direction is applied thereon; and a toe holding means translatably connected to the top plate so that lateral force applied to the toe holding means is transferred to the top plate, having toe safety release means which will release when the toe holding means is translated.

13. A ski binding as claimed in claim 12 wherein the static base plate is attached to the ski or ski board, in a central portion of the static base plate.

14. A safety ski binding for releasably securing a boot having a toe portion and a heel portion to a ski or a ski board comprising:

a static base plate capable of being fixedly attached to said ski or ski board;

a top plate pivotally attached to the static base plate in a manner that permits pivotal movement of generally said entire top plate around a vertical axis;

a biasing means for biasing the top plate towards a predetermined position;

a toe holding means having first vertical pivot means connected to the said base plate and second vertical pivot means connected to the said top plate such that said toe holding means can pivot around said first vertical pivot means when a lateral force is applied to the toe portion of the boot causing lateral displacement of said top plate from the predetermined position and the release of the boot; and a heel holding means having third vertical pivot means connected to the said base plate and fourth vertical pivot means connected to the said top plate such that said heel holding means can pivot around said third vertical pivot means when a lateral force is applied to the heel portion of the boot causing lateral displacement of said top plate from the predetermined position and the release of the boot.

* * * * *